US009441594B2

(12) United States Patent
Ayanji

(10) Patent No.: US 9,441,594 B2
(45) Date of Patent: Sep. 13, 2016

(54) VALVE ACTUATOR ASSEMBLY WITH CURRENT TRIM AND FUEL INJECTOR USING SAME

(71) Applicant: Caterpillar Inc., Peoria, IL (US)

(72) Inventor: Sudhindra Keshav Ayanji, Edwards, IL (US)

(73) Assignee: Caterpillar Inc., Peoria, IL (US)

( * ) Notice: Subject to any disclaimer, the term of this patent is extended or adjusted under 35 U.S.C. 154(b) by 243 days.

(21) Appl. No.: 14/010,655

(22) Filed: Aug. 27, 2013

(65) Prior Publication Data

US 2015/0060575 A1 Mar. 5, 2015

(51) Int. Cl.

| | |
|---|---|
| ***F02M 63/00*** | (2006.01) |
| ***F02M 47/02*** | (2006.01) |
| *F02D 41/20* | (2006.01) |
| *F02D 41/24* | (2006.01) |

(52) U.S. Cl.

CPC ..... *F02M 63/0017* (2013.01); *F02D 41/20* (2013.01); *F02M 47/027* (2013.01); *F02M 63/0042* (2013.01); *F02M 63/0078* (2013.01); *F02D 41/2467* (2013.01); *F02D 2041/2055* (2013.01); *F02D 2041/2058* (2013.01)

(58) Field of Classification Search

CPC ..... F02M 63/0017; F02M 63/0078; F02M 51/0607

USPC ..... 239/585.1, 533.4, 88, 96; 123/490, 499, 123/497, 472, 478, 480; 335/220, 261; 361/152–154

See application file for complete search history.

(56) References Cited

U.S. PATENT DOCUMENTS

| | | | | |
|---|---|---|---|---|
| 4,264,040 | A * | 4/1981 | Saito | F02M 51/0632 239/585.1 |
| 4,604,675 | A * | 8/1986 | Pflederer | F02D 41/20 123/490 |
| 4,922,878 | A * | 5/1990 | Shinogle | F02D 41/20 123/490 |
| 4,978,074 | A | 12/1990 | Weinand | |
| 6,298,829 | B1 | 10/2001 | Welch et al. | |
| 6,752,332 | B1 | 6/2004 | Terakado et al. | |
| 6,871,800 | B2 * | 3/2005 | Tinwell | F02M 51/0685 239/533.2 |
| 6,945,508 | B2 * | 9/2005 | Lewis | F02M 63/0017 251/129.02 |
| 7,051,961 | B2 | 5/2006 | Mills et al. | |
| 7,057,870 | B2 * | 6/2006 | Meyer | F02D 41/20 361/139 |
| 7,309,025 | B2 * | 12/2007 | Yamazaki | F02D 41/20 239/5 |

(Continued)

FOREIGN PATENT DOCUMENTS

| | | |
|---|---|---|
| WO | 2013/020740 | 2/2013 |
| WO | 2013/031422 | 3/2013 |

*Primary Examiner* — Arthur O Hall
*Assistant Examiner* — Joseph A Greenlund

(57) ABSTRACT

A valve actuator assembly includes a valve member movable between a first seat and a second seat. A spring member biases the valve member toward the first seat, and an actuator is positioned to move the valve member toward the second seat against the bias of the spring member when the actuator is energized. A controller is in control communication with the actuator and is configured to provide a first current to the actuator for an energizing period, identify a lack of return contact between the valve member and the first seat during a post-energizing period, and provide a second current to the actuator that is higher than the first current in response to the lack of return contact.

20 Claims, 3 Drawing Sheets

(56) References Cited

U.S. PATENT DOCUMENTS

| | | | | |
|---|---|---|---|---|
| 7,328,690 | B2 * | 2/2008 | Sheikh | F02D 41/20 123/458 |
| 7,483,253 | B2 * | 1/2009 | Schumacher | H01F 7/1805 361/160 |
| 7,656,641 | B2 * | 2/2010 | Mason, Jr. | H01H 47/32 361/160 |
| 8,020,533 | B2 * | 9/2011 | Tsuchiya | F02M 51/0603 123/478 |
| 8,055,460 | B2 * | 11/2011 | Rajagopalan | G01R 31/06 324/415 |
| 8,061,333 | B2 * | 11/2011 | Bolz | F02D 41/20 123/476 |
| 8,105,703 | B2 * | 1/2012 | Wang | B82Y 10/00 360/110 |
| 8,214,132 | B2 * | 7/2012 | Bunni | F02D 41/20 123/472 |
| 8,725,392 | B2 * | 5/2014 | Bolz | F02D 41/20 123/478 |
| 8,807,120 | B2 * | 8/2014 | Beer | F02D 41/20 123/472 |
| 8,960,157 | B2 * | 2/2015 | Kusakabe | F02D 41/20 123/472 |
| 2007/0028895 | A1 * | 2/2007 | Fujii | 123/446 |
| 2012/0031378 | A1 * | 2/2012 | Brandt | 123/490 |
| 2012/0216783 | A1 | 8/2012 | Kusakabe et al. | |
| 2014/0240886 | A1 * | 8/2014 | Itaya | F02D 41/20 361/178 |

* cited by examiner

VALVE ACTUATOR ASSEMBLY WITH CURRENT TRIM AND FUEL INJECTOR USING SAME

TECHNICAL FIELD

The present disclosure relates generally to a current trim strategy for a valve actuator assembly.

BACKGROUND

Engines utilize fuel injectors to introduce fuel into the combustion chambers of the engine. Although there exist fuel systems and fuel injectors of various types, fuel injectors typically utilize valves that are actuated in any of a number of different ways. For example, fuel injectors and their associated valves may be actuated mechanically, hydraulically, electronically, or using a combination of different actuation means. A specific type of valve actuator that may be used in fuel injectors is a solenoid actuated valve. The solenoid may include a solenoid coil, which acts as a magnet when provided with current, an armature, and a biasing spring. When the solenoid coil is energized, the armature is drawn toward the solenoid coil, and the valve member is moved toward or away from a valve seat. The biasing spring assists in returning the valve member to a seated position. These solenoid actuated valves may be particularly useful in accurately injecting different volumes of fuel in a broad range at precise timings in a limited spatial envelope.

Repeated contact between valve actuator assembly components during operation of the fuel injector may result in component wear that can impact performance of the fuel injector. For example, such wear may result in a gap between the valve member and valve seat and, eventually, result in failure of the fuel injector. To reduce valve wear, U.S. Pat. No. 6,752,332 to Terakado et al. suggests forming a surface reforming layer, such as a nitrided layer, having wear resistance on a surface of worn portions of the fuel injector. Such worn portions may include the valve body, valve seat, and stopper. Although the surface reforming layer of the Terakado et al. reference may be useful in some applications, it should be appreciated that a continuing need exists for improving performance of valve actuator assemblies and/or extending the useful life of such components.

The present disclosure is directed to one or more of the problems or issues set forth above.

SUMMARY OF THE DISCLOSURE

In one aspect, a valve actuator assembly includes a valve member movable between a first seat and a second seat. A spring member biases the valve member toward the first seat, and an actuator is positioned to move the valve member toward the second seat when the actuator is energized. A controller is in control communication with the actuator and is configured to provide a first current to the actuator for an energizing period, identify a lack of return contact between the valve member and the first seat during a post-energizing period, and provide a second current to the actuator that is higher than the first current in response to the lack of return contact.

In another aspect, a method of operating a valve actuator assembly is provided. The valve actuator assembly includes a valve member movable between a first seat and a second seat, an actuator positioned to move the valve member toward the second seat when the actuator is energized, and a controller in control communication with the actuator. The method includes steps of biasing the valve member toward the first seat using a spring member, providing a first current from the controller to the actuator for an energizing period, identifying a lack of return contact between the valve member and the first seat during a post-energizing period, and providing a second current to the actuator that is higher than the first current in response to the lack of return contact.

In yet another aspect, a fuel injector includes an injector body and a valve actuator assembly disposed within the injector body. The valve actuator assembly includes a valve member movable between a first seat and a second seat, and an armature coupled to the valve member. A spring member biases the valve member toward the first seat using the armature. A solenoid coil is positioned to move the valve member toward the second seat against the bias of the spring member when the solenoid coil is energized using the armature. A controller is in control communication with the solenoid coil and is configured to provide a first current to the solenoid coil for an energizing period, identify a lack of return contact between the valve member and the first seat during a post-energizing period, and provide a second current to the solenoid coil that is higher than the first current in response to the lack of return contact.

DETAILED DESCRIPTION

Figure 1:
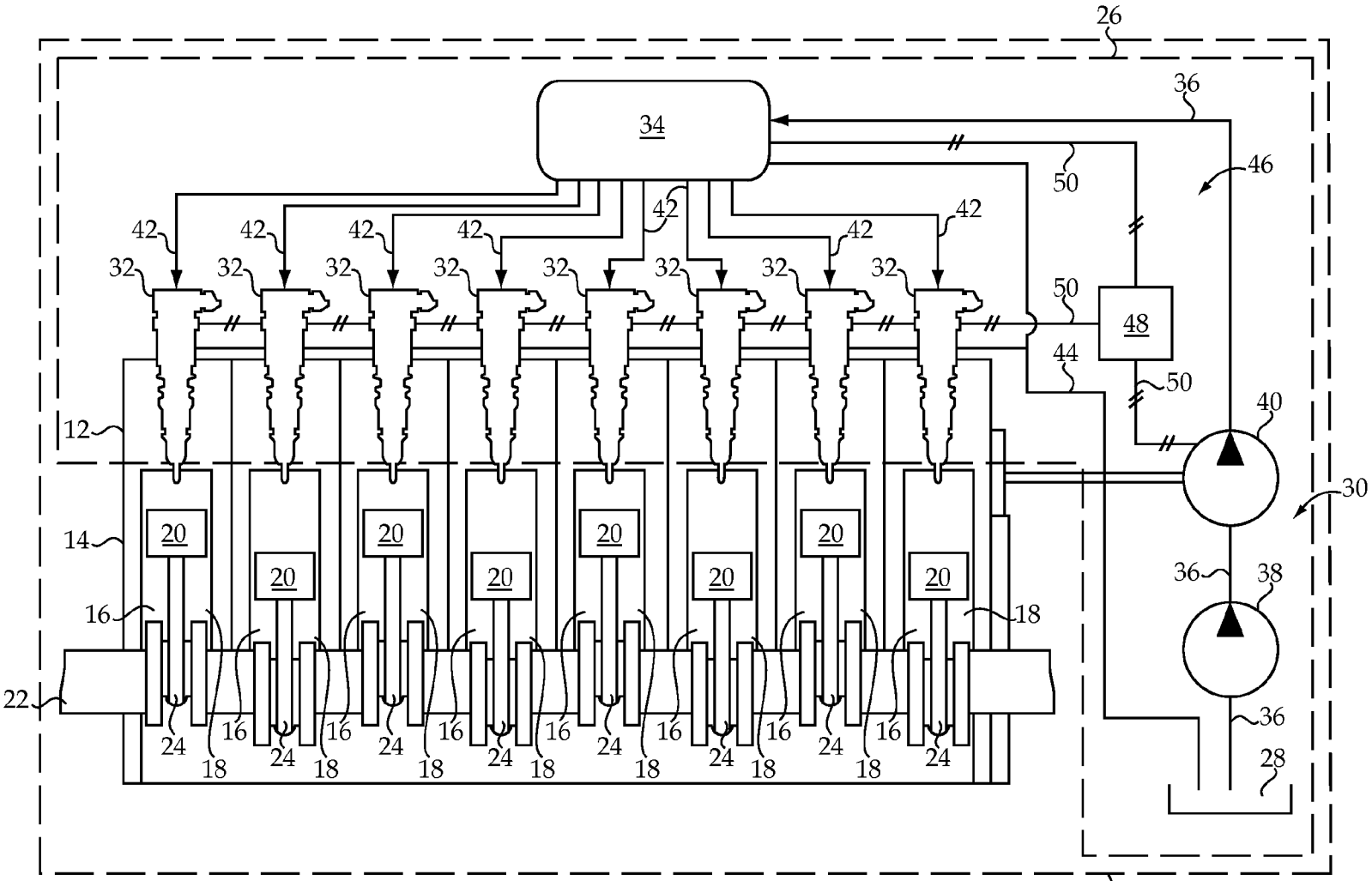
FIG. 1 is a schematic view of a fuel system for an engine, according to the present disclosure.

Referring to the schematic of FIG. 1, an engine system 10 may generally include an engine 12, such as a compression ignition engine. The engine 12 may include an engine block 14 that defines a plurality of cylinders 16, the number of which may vary, each of which forms a combustion chamber 18. A piston 20 is slidable within each cylinder 16 to compress air within the respective combustion chamber 18. The engine 12 also includes a crankshaft 22 that is rotatably disposed within the engine block 14. A connecting rod 24 may connect each piston 20 with the crankshaft 22 such that sliding motion of the pistons 20 within each respective cylinder 16 results in a rotation of the crankshaft 22.

The engine system 10 may also include a fuel system 26 for supplying fuel into each of the combustion chambers 18 during operation of the engine 12. The fuel system 26, which may be a common rail fuel system, may include a fuel tank 28 configured to hold a supply of fuel, and a fuel pumping arrangement 30 configured to pressurize the fuel and direct the pressurized fuel to a plurality of fuel injectors 32 by way of a common rail 34. The fuel pumping arrangement 30 may include one or more pumping devices that function to increase the pressure of the fuel and direct one or more pressurized streams of fuel to the common rail 34 using fuel lines 36. For example, the fuel pumping arrangement 30 may include a fuel transfer pump 38, or low pressure fuel pump, that draws fuel from the fuel tank 28 and pumps pressurized fuel to a high pressure fuel pump 40. The high pressure fuel pump 40 increases the pressure of the fuel and pumps the high pressure fuel to the common rail 34.

The fuel injectors 32 may be disposed within a portion of the cylinder block/head 14, as shown, and may be connected to the common rail 34 via a plurality of individual branch passages 42. Each fuel injector 32 may be operable to inject an amount of pressurized fuel into an associated combustion chamber 18 at predetermined timings, fuel pressures, and fuel flow rates. The timing of fuel injection into the combustion chambers 18 may be synchronized with the motion of the pistons 20. For example, fuel may be injected as piston 20 nears a top-dead-center position in a compression stroke to allow for compression-ignited combustion of the injected fuel. Alternatively, fuel may be injected as piston 20 begins the compression stroke heading towards a top-dead-center position for homogenous charge compression ignition operation. As shown, fuel injectors 32 may also be fluidly connected to fuel tank 28 via one or more drain lines 44.

A control system 46 may be associated with fuel system 26 and/or engine system 10 to monitor and control the operations of the fuel pumping arrangement 30, fuel injectors 32, and various other components of the fuel system 26. In particular, and according to the exemplary embodiment, the control system 46 may include an electronic controller 48 in communication with the high pressure fuel pump 40 and each of the fuel injectors 32 via communication lines 50. For example, the electronic controller 48 may be configured to control pressurization rates and injection, thus improving performance and control of the engine 12. Although a particular embodiment is shown, it should be appreciated that the control system 46 may be configured to provide any desired level of control, and may include any number of components and/or devices, such as, for example, sensors, useful in providing the desired control.

Figure 2:
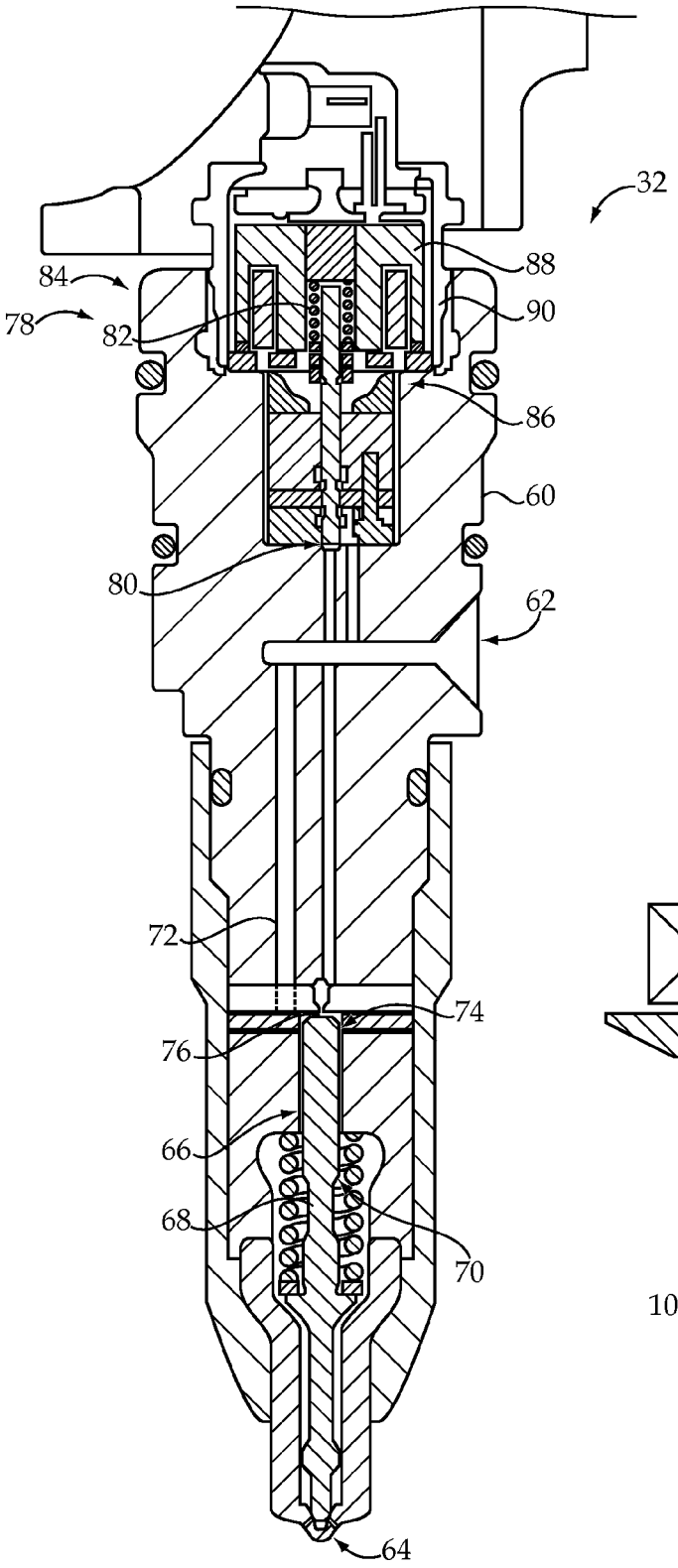
FIG. 2 is a partially sectioned side diagrammatic view of one of the fuel injectors of the fuel system of FIG. 1.

Turning now to FIG. 2, one of the fuel injectors 32, according to a particular embodiment, is shown in greater detail. The fuel injector 32 generally includes an injector body 60 defining a fuel inlet 62, which may receive fuel from common rail 34 of FIG. 1 via passage 42, and a drain outlet (not shown), which may be fluidly connected with drain line 44. A nozzle outlet 64 is also defined by the injector body 60 and may open into an associated combustion chamber 18. The fuel injector 32 may include a direct operated check valve 66 that is positioned in injector body 60 and includes a needle valve member 68 with an opening hydraulic surface 70 exposed to fluid pressure in a nozzle supply passage 72, which is fluidly connected to the fuel inlet 62. In addition, needle valve member 68 includes a closing hydraulic surface 74 exposed to fluid pressure in a needle control chamber 76. The needle valve member 68 is movable between a first position (as shown) in which the nozzle supply passage 72 is blocked relative to nozzle outlet 64, and a second position in which nozzle supply passage 72 is open relative to nozzle outlet 64 for an injection event.

A valve actuator assembly 78 is disposed at least partially within the injector body 60 and includes a valve member 80. A spring member 82 biases the valve member 80 toward a closed position in which the needle control chamber 76 is fluidly blocked relative to the drain outlet. An actuator 84 is positioned to move the valve member 80 upward, toward an open position in which the needle control chamber 76 is fluidly connected to the drain outlet. According to the exemplary embodiment, the actuator 84 may include an armature 86 coupled to the valve member 80, and a solenoid coil 88 positioned to move the valve member 80 using the armature 86 when the solenoid coil 88 is energized. That is, when the solenoid coil 88, which is disposed within a case 90, is energized, the valve member 80 is pulled upward, or unseated, to fluidly connect the needle control chamber 76 to the drain outlet.

Figure 3:
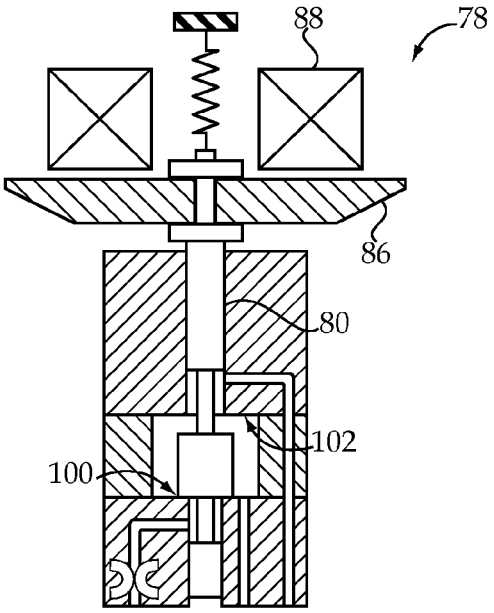
FIG. 3 is a schematic view of the valve actuator assembly of the fuel injector illustrated in FIG. 2.

Turning now to FIG. 3, a simplified schematic view of relevant components of the valve actuator assembly 78 of FIG. 2 is shown. During operation of the fuel injector 32, the valve member 80 is movable between a first seat, or closed seat, 100 and a second seat, or open seat, 102. The spring member 82, shown in FIG. 2, biases the valve member 80 using armature 86 toward the first seat 100. The solenoid coil 88 is positioned to move the valve member 80 toward the second seat 102 against the spring member biasing when the solenoid coil 88 is energized. That is, when a current is supplied to the solenoid coil 88, via the electronic controller 48 of FIG. 1, a magnetic field forms and the solenoid coil 88 becomes a magnet. Because the armature 86 includes magnetically attractive material, such as, for example, a ferromagnetic material, the armature 86 is moved upwardly toward the solenoid coil 88. The valve member 80, which is coupled with the armature 86, is also moved upward and toward the second seat 102 when current is supplied to the solenoid coil 88. This valve opening results in opening of the needle valve member 68 for a fuel injection event. Upon cessation of current to the solenoid coil 88, the armature 86 and valve member 80 are returned downward using the biasing force of spring member 82, and the valve member 80 returns to a seated position in contact with the first seat 100.

Figure 4:
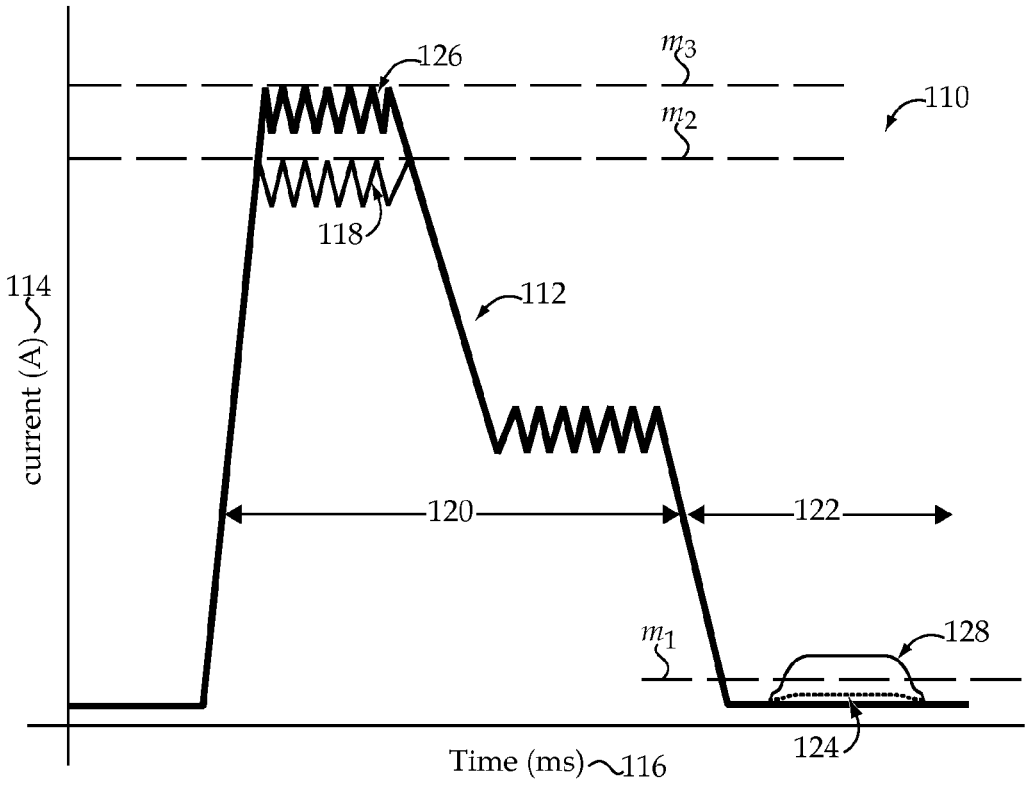
FIG. 4 is a graph depicting a current measurement corresponding to an injection event of the fuel injector of the previous FIGS. 2 and 3.

An exemplary current waveform for energizing the solenoid coil 88 is shown in graph 110 of FIG. 4 at 112. In particular, graph 110 depicts current 114 over time 116 for an injection event. For example, the electronic controller 48 is in control communication with the actuator 84 or, more specifically, the solenoid coil 88 and is configured to provide a first current 118, corresponding to current waveform 112, to the actuator 84 for an energizing period 120. The electronic controller 48 may also be configured to identify a lack of return contact between the valve member 80 and the first seat 100 during a post-energizing period 122. For example, after current is removed, or turned off, there will be a small delay until the valve member 80 is again seated. When the valve member 80 contacts, or returns into contact with, the first seat 100, a small current signal is given back. If a return current 124 is lost or is below a certain magnitude, such as magnitude $m_1$, during the post-energizing period 122, it may be determined by the electronic controller 48 that the valve member 80 did not return to a seated position against the first seat 100. It may further be determined by the electronic controller 48 that the solenoid pull force was not able to lift, or open, the armature 86 and valve member 80.

The first current 118, which is provided to the solenoid coil 88 during the energizing period 120, may have a magnitude $m_2$ corresponding to a pull force of the actuator 84. If a lack of return contact between the valve member 80 and the first seat 100 during the post-energizing period 122 is identified, the electronic controller 48 may be further configured to provide a second current 126 to the solenoid coil 88 that is higher than the first current 118. In particular, the second current 126 may have a magnitude $m_3$ that is higher, or greater, than the magnitude $m_2$ of the first current 118. This second current 126 may provide a greater pull force of the actuator 84 to ensure opening of the valve member 80. The current may be increased until a return signal 128 that is at or above the seat detect threshold $m_1$ is detected.

Figure 5:
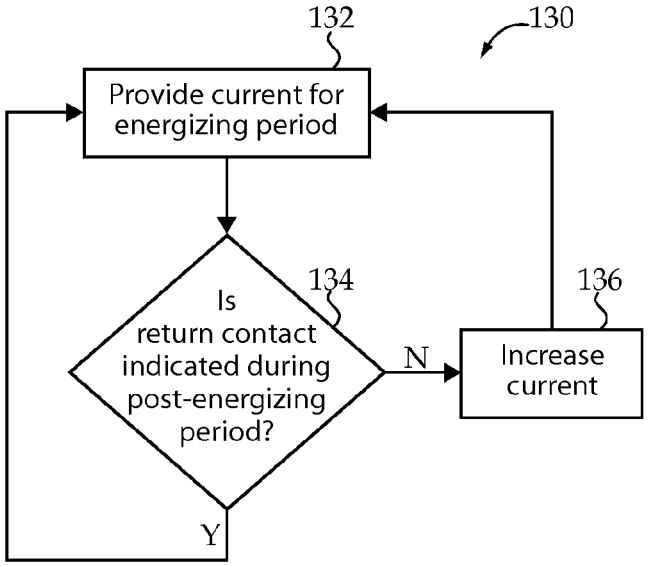
FIG. 5 is a simplified flow diagram of a method for operating the valve actuator assembly of FIG. 3.

The strategy may be implemented in a number of ways and, as shown in the simplified flow diagram 130 of FIG. 5, will generally include a step of providing a current, such as first current 118 of FIG. 4, for an energizing period, such as energizing period 120 of FIG. 4, at Block 132. The electronic controller 48, or other electronic control device, will then determine whether return contact of the valve member 80 to first seat 100 is indicated during a post-energizing period, such as post-energizing period 122, at Block 134. That is, it may be determined by the electronic controller 48 that the valve member 80 was not lifted by the actuator 84 since return contact, or return seating, was not detected. As stated above, the return contact of the valve member 80 to the first seat 100 will typically generate a small return signal or current that may be detected by the electronic controller 48.

If return contact is indicated at Block 134, the method will proceed to Block 132. However, if return contact is not detected at Block 134, the method proceeds to Block 136. At Block 136, the current provided to the actuator 84 for lifting the valve member 80 will be increased. For example, a second current, such as second current 126 of FIG. 4, which is higher than the first current 118, may be provided to the actuator 84. The current may be increased in steps or according to a closed feedback loop until return contact between the valve member 80 to the first seat 100 is detected.

According to some embodiments, the armature 86 may be made from a cobalt-iron alloy to increase a magnetic flux density of the armature 86. For example, the armature 86 may be made from a composition that is approximately 49% cobalt, 49% iron, and 2% vanadium. Alternatively, or additionally, the case 90, within which the solenoid coil 88 is disposed, may be made from stainless steel, such as, for example, non-magnetic stainless steel grades 303 or 304. Utilizing the stainless steel case 90 may decrease transmission of magnetic flux from the solenoid coil 88. Utilizing these alternative materials may permit the use of a first current, such as first current 118, that has a lower magnitude than would otherwise be required. As such, the current 112, or magnitude, may be increased in response to lack of return contact, as described herein, throughout the life of the actuator 84.

INDUSTRIAL APPLICABILITY

The present disclosure finds general applicability in any valve actuator assembly, but may be specifically applicable to an electromechanically operated valve, such as a solenoid actuated valve. The valve actuator assembly described herein may be used in fuel injectors, including those used in common rail fuel systems. Although a specific application is presented herein, the valve actuator assembly, as disclosed, may have applicability to other applications, including alternative fuel injectors and pumps.

Referring generally to FIGS. 1-5, a particular application of a valve actuator assembly 78, according to the present disclosure, is shown and discussed. In particular, a fuel injector 32 may include the valve actuator assembly 78 and may be operated by energizing the solenoid coil 88 to initiate an injection event. The solenoid coil 88 may then be de-energized to end an injection event. When the solenoid coil 88 is energized, the armature 86 and valve member 80 are moved upward until the valve member 80 contacts the second seat 102. With the valve member 80 in the open position, the needle control chamber 76 is fluidly connected to the drain outlet, and the needle valve member 68 is moved to a position in which nozzle supply passage 72 is open relative to nozzle outlet 64 for an injection event.

Normally, after current is removed, or turned off, there will be a small delay until the valve member 80 is again seated. When the valve member 80 contacts, or returns into contact with, the first seat 100, a small current signal is given back. If the current is lost or is below a certain magnitude, such as magnitude $m_1$, during the post-energizing period 122, it may be determined by the electronic controller 48 that the valve member 80 did not return to a seated position against the first seat 100. It may further be determined by the electronic controller 48 that the solenoid pull force was not able to lift, or open, the armature 86 and valve member 80. As such, the electronic controller 48 may be further configured to provide a second current 126 to the solenoid coil 88 that is higher than the first current 118. In particular, the second current 126 may have a magnitude $m_3$ that is higher, or greater, than the magnitude $m_2$ of the first current 118. This second current 126 may provide a greater pull force of the actuator 84 to ensure opening of the valve member 80.

Such a strategy may be useful in extending the life of the valve actuator assembly 78 and fuel injector 32. For example, repeated contact between valve actuator assembly components during operation of the fuel injector 32 may result in component wear that can impact performance of the fuel injector 32. For example, such wear may increase the air gap between the valve member 80 and valve seat 100 and, eventually, result in failure of the fuel injector 32. According to the strategy provided herein, when a lack of return contact, or re-seating, of the valve member 80 relative to the first seat 100 is detected, the electronic controller 48 may increase the current magnitude, or force, to compensate.

It should be understood that the above description is intended for illustrative purposes only, and is not intended to limit the scope of the present disclosure in any way. Thus, those skilled in the art will appreciate that other aspects of the disclosure can be obtained from a study of the drawings, the disclosure and the appended claims.

What is claimed is:

1. A valve actuator assembly, comprising:

a valve member movable between a first seat and a second seat;

a spring member biasing the valve member toward the first seat;

an actuator positioned to move the valve member toward the second seat against the spring member biasing when the actuator is energized, the actuator including an armature coupled to the valve member and a solenoid coil positioned to move the valve member using the armature when the solenoid coil is energized; and a controller in control communication with the actuator and configured to provide a first current to the actuator for an energizing period, remove the first current to the actuator to begin a post-energizing period, identify a return current in the solenoid coil having a magnitude less than or equal to a predetermined threshold indicative of a lack of return contact between the valve member and the first seat during the post-energizing period, and provide a second current to the actuator for a second energizing period, the second current being higher than the first current in response to the lack of contact.

2. The valve actuator assembly of claim 1, wherein the controller is further configured to identify a return current in the solenoid coil having a magnitude greater than a predetermined threshold indicative of return contact between the valve member and the first seat responsive to the second current.

3. The valve actuator assembly of claim 2, wherein the controller uses a feedback loop to increase the first current toward the second current.

4. The valve actuator assembly of claim 1, wherein the armature includes a cobalt-iron alloy.

5. The valve actuator assembly of claim 4, wherein the solenoid coil is disposed within a stainless steel case.

6. The valve actuator assembly of claim 1, wherein the solenoid coil is disposed within a stainless steel case.

7. A method of operating a valve actuator assembly, the valve actuator assembly including a valve member movable between a first seat and a second seat, an actuator having a solenoid coil and an armature positioned to move the valve member toward the second seat using the armature when the solenoid coil is energized is energized, and a controller in control communication with the actuator, the method comprising steps of:

biasing the valve member toward the first seat using a spring member;

providing a first current from the controller to the solenoid coil for an energizing period;

removing the first current to the solenoid coil to begin a post-energizing period;

identifying a return current in the solenoid coil having a magnitude less than or equal to a predetermined threshold indicative of a lack of return contact between the valve member and the first seat during the post-energizing period; and providing a second current to the solenoid coil for a second energizing period, the second current being higher than the first current in response to the lack of return contact.

8. The method of claim 7, further including identifying a return current in the solenoid coil having a magnitude greater than a predetermined threshold indicative of return contact between the valve member and the first seat responsive to the second current.

9. The method of claim 8, further including using a feedback loop to increase the first current toward the second current.

10. The method of claim 7, further including increasing a magnetic flux density of the armature by making the armature from a cobalt-iron alloy.

11. The method of claim 7, further including decreasing transmission of magnetic flux from the solenoid coil using a stainless steel case, wherein the solenoid coil is disposed within the stainless steel case.

12. A fuel injector, comprising:

an injector body;

a valve actuator assembly disposed within the injector body and including:

a valve member movable between a first seat and a second seat;

an armature coupled to the valve member;

a spring member biasing the valve member toward the first seat; and a solenoid coil positioned to move the valve member toward the second seat using the armature when the solenoid coil is energized; and a controller in control communication with the solenoid coil and configured to provide a first current to the solenoid coil for an energizing period, remove the first current to the solenoid coil to begin a post-energizing period, identify a return current in the solenoid coil having a magnitude less than or equal to a predetermined threshold indicative of a lack of return contact between the valve member and the first seat during the post-energizing period, and provide a second current to the solenoid coil for a second energizing period, the second current being higher than the first current in response to the lack of return contact.

13. The fuel injector of claim 12, wherein the controller is further configured to identify a return current in the solenoid coil having a magnitude greater than a predetermined threshold indicative of return contact between the valve member and the first seat responsive to the second current.

14. The fuel injector of claim 13, wherein the controller uses a feedback loop to increase the first current toward the second current.

15. The fuel injector of claim 14, wherein the controller provides the first current in a first injection event and provides the second current in a second injection event.

16. The fuel injector of claim 12, wherein the armature includes a cobalt-iron alloy.

17. The fuel injector of claim 16, wherein the solenoid coil is disposed within a stainless steel case.

18. The fuel injector of claim 12, wherein the solenoid coil is disposed within a stainless steel case.

19. The valve actuator assembly of claim 1 the controller is configured to identify a return current in the solenoid coil having a magnitude of zero.

20. The method of claim 7 wherein the magnitude of the return current is zero.

* * * * *